United States Patent [19]

Heitmann

[11] Patent Number: 4,901,740

[45] Date of Patent: Feb. 20, 1990

[54] APPARATUS FOR THREADING WEBS IN CIGARETTE ROD MAKING MACHINES AND THE LIKE

[75] Inventor: Uwe Heitmann, Hamburg, Fed. Rep. of Germany

[73] Assignee: Körber AG, Hamburg, Fed. Rep. of Germany

[21] Appl. No.: 561,224

[22] Filed: Dec. 14, 1983

[30] Foreign Application Priority Data

Dec. 27, 1982 [DE] Fed. Rep. of Germany ..... 3248149

[51] Int. Cl.[4] ..... A24C 5/20

[52] U.S. Cl. ..... 131/280; 131/84.1

[58] Field of Search ..... 131/280, 84 R, 84 A, 131/84 B, 84 C, 84.1, 84.2, 84.3, 84.4; 156/159; 242/58.4

[56] References Cited

U.S. PATENT DOCUMENTS

| | | | |
|---|---|---|---|
| 3,925,131 | 12/1975 | Krause | 156/159 |
| 4,010,911 | 3/1977 | Heitmann | 242/58.4 |
| 4,125,570 | 11/1979 | Heitmann | 131/84.3 |
| 4,185,644 | 1/1980 | Heitmann et al. | 131/109.1 |
| 4,235,248 | 11/1980 | Schumacher | 131/280 |
| 4,291,713 | 9/1981 | Frank | 131/68 |
| 4,368,743 | 1/1983 | Barbe et al. | 131/88 |

FOREIGN PATENT DOCUMENTS

| | | |
|---|---|---|
| 3037376 | 4/1981 | Fed. Rep. of Germany . |
| 3150575 | 8/1982 | Fed. Rep. of Germany . |
| 3209409 | 10/1982 | Fed. Rep. of Germany . |

*Primary Examiner*—V. Millin

*Attorney, Agent, or Firm*—Peter K. Kontler

[57] ABSTRACT

The leader of a web of cigarette paper in a cigarette rod making machine is threaded through the nip or nips one or more advancing rollers, a web bronzing device and one or more imprinting mechanisms by an apparatus employing an endless toothed belt conveyor or a chain conveyor having a stretch which is adjacent to the path of movement of the web. The conveyor carries a pin, a tongs or another suitable entraining member which is connected to the leader of the web before the conveyor is set in motion to advance the web along the path. One roller of each pair of advancing rollers is automatically retracted to allow for the passage of the leader of the web as well as of the entraining member through the nip or nips. The obstructions in the imprinting mechanism(s) and in the bronzing device are treated in the same way, i.e., one component of the pair of components which define a obstruction is retracted to permit passage of the entraining member. The width of a obstruction is reduced to normal as soon as the entraining member has advanced therethrough or when the entraining member completes its movement along the path for the web. Retraction of one component of each pair of components which define a obstruction can be effected by an electromagnet or by a pneumatic motor in response to signals from a control circuit.

20 Claims, 3 Drawing Sheets

APPARATUS FOR THREADING WEBS IN CIGARETTE ROD MAKING MACHINES AND THE LIKE

BACKGROUND OF THE INVENTION

The present invention relates to machines for processing webs of flexible material, such as paper, foil or the like. More particularly, the invention relates to improvements in machines wherein a web of flexible material must be threaded through one or more units to thereupon advance along a predetermined path to a subdividing, wrapping, folding, draping, tucking, coating and/or other station. Typical examples of such machines are cigarette rod making machines or filter rod making machines wherein a web of cigarette paper, imitation cork or other suitable material is drawn off a reel and must be advanced toward and through a wrapping station wherein it is draped around a rapidly advancing rod-like filler of tobacco or filter material to form therewith a continuous cigarette rod or filter rod. The following description will deal primarily with cigarette rod making machines but it will be readily appreciated that the invention can be embodied with equal advantage in filter rod making or other types of machines wherein the web must advance along a rather complex path and the threading of a fresh web, or of the leader of a broken web, should be completed with little loss in time.

The threading of a web of cigarette paper in a cigarette rod making machine involves introduction of the web into a path which extends through one or more imprinting mechanisms and a so-called bronzing device. Furthermore, the web must be caused to pass through the nip or nips of one or more pairs of advancing rollers one of which is normally driven and the other of which is biased against the one roller by a spring or the like. The leader of the web must be advanced all the way to a belt conveyor which transports the web and a rod-like tobacco filler through a wrapping mechanism (garniture) wherein the web is draped around the filler and its marginal portions are bonded to each other to form the customary seam of the finished tubular envelope of the cigarette rod. In many instances, the upper reach of the just mentioned belt conveyor is horizontal and the web of cigarette paper is threaded through the cigarette making machine at a level below such upper reach.

Manual threading of a web of cigarette paper through the nip or nips of one or more pairs of advancing rollers, through a bronzing device and through one or more imprinting mechanisms is a time-consuming and tedious operation which must be carried out with great care. The web is relatively thin and its tensile strength is low so that it is likely to break during threading. Furthermore, the path along which the web must be threaded is quite complex; this is due to the fact that the maker of the cigarette rod making machine strives to accommodate the bronzing device and one or more imprinting mechanisms in a small area. As a rule, the path for the web of cigarette paper is a complex meandering path, and the person in charge of threading the web must be familiar with the operation of the machine in order to ensure that the web will be transported through various mechanisms, advancing means and/or other devices in a predetermined sequence.

It was already proposed to provide an apparatus which should replace manual threading with automatic threading of a cigarette paper web or the like. For example, German Offenlegungsschrift No. 3,150,575 discloses an apparatus which is designed to advance the leader of a web of cigarette paper from the reel (i.e., from the outermost convolution of the convoluted web) to the nip of the first advancing rollers by resorting to air streams which are caused to flow in suitably configurated channels. A drawback of such proposal is that the apparatus is very complex, bulky, expensive and prone to malfunction. Moreover, the range of such apparatus is extremely limited, i.e., it is merely capable of advancing the leader of a web through a relatively short distance and along the simplest portion of the complex path wherein the web must be advanced on its way to the belt conveyor of the wrapping mechanism. The leader of a web which is threaded by the apparatus of this German publication does not even extend through the nip of the first or foremost pair of advancing rollers so that each and every difficult stage of the threading operation must still be performed by hand. This renders the proposed apparatus practically useless and does not warrant the expenditure of installing such apparatus in a cigarette rod making, filter rod making or like machine.

In accordance with another prior proposal which is described in German Offenlegungsschrift No. 3,037,376, the leader of the cigarette paper web is attracted by suction to the belt conveyor of the garniture to thus effect automatic threading of the web through the wrapping mechanism. A similar proposal is described in German Offenlegungsschrift No. 3,209,409 which further proposes to mechanically urge the web by one or more rollers, for example, by a set of rollers which are carried exclusively by a resiliently mounted lever. Thus, whereas the Offenlegungsschrift No. 3,150,575 proposes to automatically thread the web through the first or foremost portion of the path, the other two German publications disclose automatic threading of the web through the last portion of the path. None of these prior publications contain a proposal or disclose any means for threading the web along the most difficult and longest portion of the path, namely along that portion which extends through the nip or nips of one or more advancing rollers, through one or more imprinting mechanisms, and through a bronzing device. Consequently, even if a cigarette rod making machine were to embody the teachings of all of the aforementioned prior publications, the major part of the threading operation would still have to be carried out by hand with attendant pronounced losses in the output of a machine which is designed to turn out well in excess of one hundred discrete smokers' products per second.

OBJECTS AND SUMMARY OF THE INVENTION

An object of the invention is to provide a novel and improved apparatus which can be used to thread a web of cigarette paper, imitation cork or a like flexible material through a series of units in a cigarette rod making, filter rod making or other machine within a fraction of the time which is required for such operation in accordance with heretofore known proposals and techniques.

Another object of the invention is to provide an apparatus which can thread a web of cigarette paper or the like along a complex and elongated path, especially along that portion of the path which is not contemplated by the proposals in the aforediscussed prior art references.

A further object of the invention is to provide an apparatus which can thread a web of cigarette paper through the major part of the path along which the web must extend in a cigarette rod making machine on its way from a source of supply (normally a web of convoluted cigarette paper) to the wrapping mechanism.

An additional object of the invention is to provide an apparatus which can be used to reliably thread a web of cigarette paper or the like through several units of a machine without any assistance on the part of the operator, which can be installed in existing cigarette rod making and analogous machines at a reasonable cost and without necessitating substantial alterations of such machines, and which treats the webs gently so that they are not likely to be smudged, mutilated and/or otherwise damaged during threading.

Still another object of the invention is to provide a threading apparatus whose controls are surprisingly simple, compact and inexpensive, which can be manipulated by an attendant with a minimum of training, and which can be readily designed to advance webs of cigarette paper or the like along relatively short, medium long or relatively long paths.

An additional object of the invention is to provide a web processing machine which embodies or cooperates with the above outlined threading apparatus.

Another object of the invention is to provide a threading apparatus which contributes significantly to the output of a cigarette rod making, filter rod making or other web processing machine by reducing the down times of such machines.

A further object of the invention is to provide a novel and improved method of threading a flexible web through a complex path in a cigarette rod making or other processing machine.

An additional object of the invention is to provide a method of automatically threading a cigarette paper web through one or more imprinting mechanisms, a bronzing device and/or one or more pairs of advancing rollers in a cigarette rod making machine.

One feature of the invention resides in the provision of an apparatus for threading an elongated flexible web through a processing machine (particularly for threading a web of cigarette paper through a cigarette rod making machine) wherein the properly threaded web advances in a predetermined direction along a predetermined path and wherein a portion of the path includes or obstruction an expandible constriction whose width normally suffices solely or exclusively for advancement of the web therethrough (such obstruction can constitute the nip of two rotary elements one of which is biased toward the other rotary element). The apparatus comprises an endless flexible conveyor (e.g., a chain conveyor or a toothed belt) having a portion which extends along the path, means for driving the conveyor in the predetermined direction (when necessary to thread a web through the machine), entraining means (e.g., a pin or a web clamping device in the form of a tongs or the like) which is provided on the conveyor and serves to engage the leader of a web which is to be threaded through the machine, and means for expanding the obstruction of the path at least while the entraining means advances the leader therethrough so that the expanded obstruction does not interfere with advancement of the entraining means along the path.

The path is or can be defined by a plurality of first rotary elements in the form of rollers or wheels, and the apparatus then preferably further comprises a plurality of second rotary elements (e.g., sprocket wheels or toothed pulleys, depending on the type of the conveyor) each of which is coaxial with a discrete one of the first rotary elements. The conveyor is trained over the second rotary elements.

The apparatus can further comprise means for transmitting motion from the prime mover of the machine to the driving means, and such motion transmitting means can comprise a clutch. The apparatus then further comprises means for engaging and disengaging the clutch. Alternatively, the apparatus can comprise a discrete prime mover for the driving means.

If the entraining means includes or constitutes a pin or a like part, the leader of the web is preferably provided with or constitutes a loop into which the entraining means extends during movement with the leader along the path.

Another feature of the invention resides in the provision of a processing machine which comprises the aforedescribed novel apparatus and which further comprises guide means defining the aforementioned path for a web of cigarette paper of the like. The guide means includes the aforementioned first rotary elements and such elements preferably include at least one pair of components one of which is movable toward and away from the other component and defines therewith the aforementioned obstruction. The moving means can comprise a control circuit which can effect movements of the one component away from the other component through the medium of an electromagnet or another suitable motor. A spring can be provided to permanently bias the one component in a direction to reduce the width of the obstruction. The machine preferably further comprises signal generating monitoring means (e.g., one or more photocells) adjacent to at least one selected portion of the path and arranged to transmit to the control circuit signals in response to detection of the entraining means in the selected portion of the path. Such signals can be used to effect a return movement of the one component toward the other component and/or to disengage the aforementioned clutch and/or to otherwise arrest the driving means.

The novel features which are considered as characteristic of the invention are set forth in particular in the appended claims. The improved web threading apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
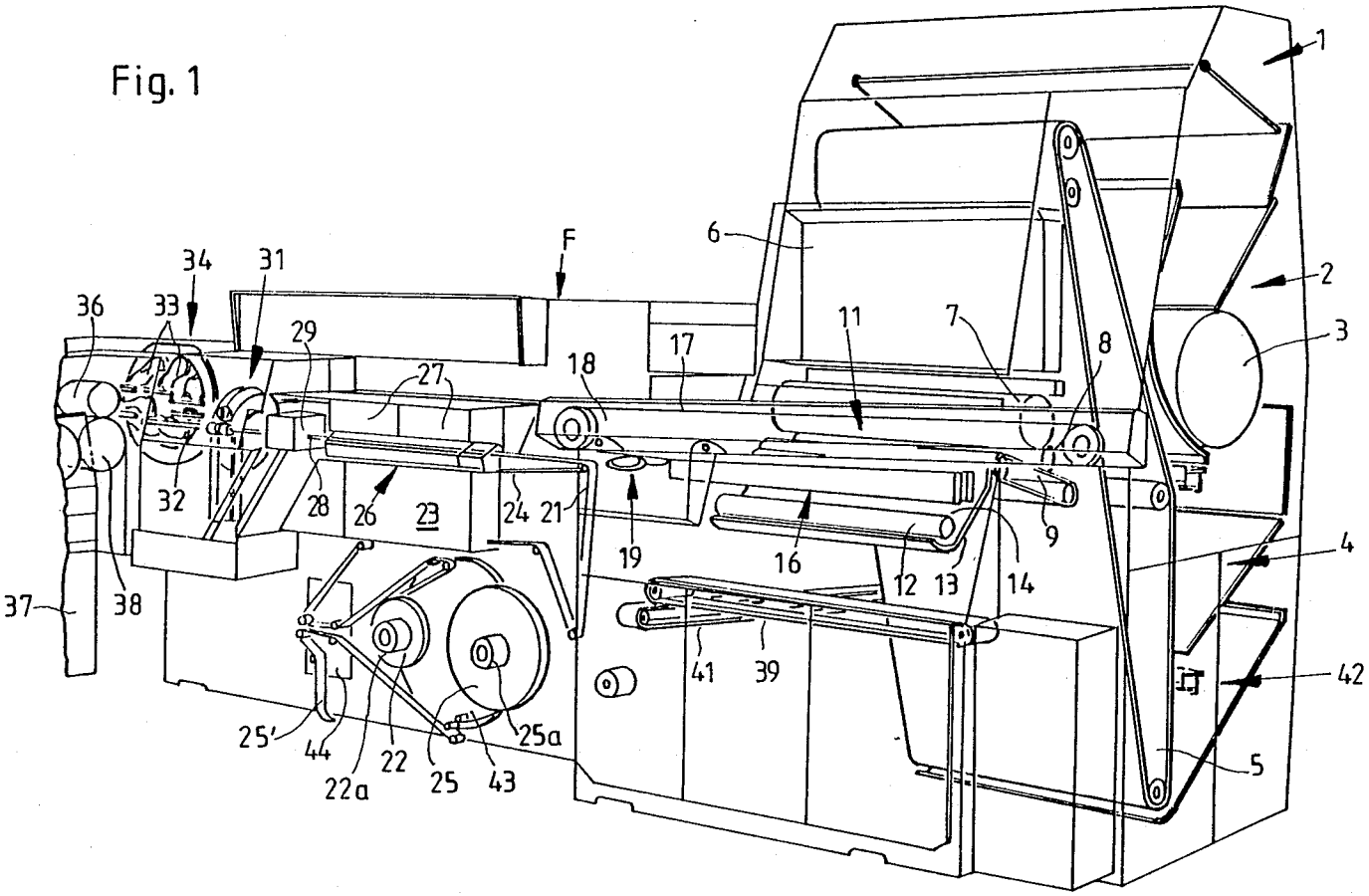
FIG. 1 is a somewhat schematic perspective view of a cigarette rod making machine which embodies the improved web threading apparatus.

Referring to FIG. 1, there is shown a cigarette rod making machine of the type known as PROTOS which is manufactured and sold by the assignee of the present application. The machine comprises a frame F supporting a pivotable or otherwise movable gate 1 which admits batches of tobacco particles at requisite intervals into a first or preliminary distributor 2. A carded drum 3 or an analogous withdrawing device draws tobacco particles from the distributor 2 and admits them into a main magazine 4 whenever the quantity of tobacco particles in the main magazine is depleted below a preselected minimum acceptable value. One side of the main magazine 4 is open and is adjacent to the upwardly moving reach of an endless belt conveyor 5 having pockets which serve to remove small batches of tobacco particles and to dump such batches into an upright duct 6 at a rate such that the level of the top surface of the column of tobacco particles in the duct fluctuates very little or not at all. The lower end of the duct 6 is adjacent to a driven carded drum 7 whose carding entrains particles of tobacco into the range of a rapidly rotating picker roller 8 serving to shower the particles onto the upper reach of a substantially horizontal apron conveyor 9 which is driven at a constant speed and propels the leading edge of the thus formed carpet of tobacco particles into the range of a classifying device 11. The latter comprises a plenum chamber serving to discharge a curtain of compressed air which is traversed by the larger and/or heavier tobacco particles but deflects the lighter tobacco particles (primarily shreds) into a downwardly extending funnel 14 defined by a wall 13 and a carded drum 12. The carding of the drum 12 propels the lighter tobacco particles upwardly against the underside of an elongated tobacco stream forming conveyor 17 at the upper side of an elongated narrow tobacco channel 16. The lower reach of the conveyor 17 is adjacent to the underside of the foraminous bottom wall of a suction chamber 18 which causes the conveyor 17 to accumulate a growing tobacco stream. The fully grown tobacco stream contains a surplus of tobacco particles, and such surplus is removed by a trimming or equalizing device 19 so that the stream is converted into an elongated rod-like filler having a constant or nearly constant cross-sectional outline. Successive increments of the filler are deposited on successive increments of a continuous cigarette paper web 21 which advances in the same direction and at the same speed. The web 21 is drawn off a bobbin or reel 22 and is caused to advance through an imprinting mechanism 23 which provides spaced-apart portions of the web with indicia denoting the trademark or trademarks, the name of the manufacturer or the brand name and/or other information pertaining to the product. The means for advancing the web 21 in the direction of advancement of the filler and at the same speed comprises an endless belt conveyor 24 whose upper reach transports the web 21 and the filler through a wrapping mechanism (garniture) 26 wherein the web is draped around the filler in such a way that one marginal portion of the draped web extends substantially tangentially of and away from the filler. Such marginal portion is then coated with adhesive by a suitable paster (not shown) and is folded over the other marginal portion to form therewith an elongated seam extending in parallelism with the axis of the resulting cigarette rod 28. The seam is thereupon heated or cooled (depending on the nature of the adhesive) by a sealer 27 (e.g., a tandem sealer of the type disclosed in commonly owned U.S. Pat. No. 4,291,713 granted Sept. 29, 1981 to Willi Frank) to effect rapid setting of the adhesive before the rod 28 is caused to pass through a density monitoring device 29 which regulates the operation of the equalizing device 19 in such a way that the latter removes a greater or lesser percentage of tobacco in order to ensure that the density of the filler in the rod 28 will match or closely approximate an optimum value. A cutoff 31 subdivides the rod 28 into a file of discrete plain cigarettes 32 of double unit length.

Successive plain cigarettes 32 of double unit length advance into the range of successive arms 33 of a transfer unit 34 which delivers the cigarettes onto a drum-shaped conveyor 36 constituting an element of a filter tipping machine 37, e.g., a machine known as MAX S which is manufactured and sold by the assignee of the present application. The construction and mode of operation of a MAX S machine are described, for example, in commonly owned U.S. Pat. No. 4,368,743 granted Jan. 18, 1983 to Karl-Heinz Barbe et al. The machine 37 comprises a severing conveyor 38 which cooperates with a circular knife (not shown) serving to subdivide successive plain cigarettes 32 of double unit length into plain cigarettes of unit length which are thereupon assembled with filter rod sections to form filter cigarettes in a manner not forming part of the present invention.

FIG. 1 further shows conveyors 39, 41 which receive the surplus of tobacco particles at a station below the equalizing device 19 and return the surplus into a magazine 42 which is adjacent to the conveyor 5 at a level below the main magazine 4 so that the aforementioned pockets of the conveyor 5 receive relatively small quantities of recirculated surplus tobacco prior to receiving tobacco shreds from the main magazine 4. The construction of those parts of the cigarette rod making machine of FIG. 1 which serve to process tobacco particles between the gate 1 and the conveyor 17 is similar to that disclosed in commonly owned U.S. Pat. No. 4,185,644 granted Jan. 29, 1980 to Uwe Heitmann et al. Reference may also be had to commonly owned U.S. Pat. No. 4,235,248 granted Nov. 25, 1980 to Peter Schumacher which discloses the manner in which the height of the tobacco column in the duct (6) is prevented from fluctuating within a wide range, and to commonly owned U.S. Pat. No. 4,175,570 granted Nov. 27, 1979 to Uwe Heitmann which describes and shows in greater detail the manner in which the conveyor (17) accumulates an elongated tobacco stream.

The reel 22 is mounted on a spindle **22*a* which is installed on a support 43 pivotable about a horizontal axis at the front side of the frame F. This support is provided with a second spindle 25*a* for a fresh bobbin or reel 25 whose leader 25' is held in a splicing apparatus 44. The apparatus 44 is activated shortly prior to expiration of the web 21 on the reel 22 so that the trailing portion of the web 21 is spliced to the leader 25' and the reel 25 begins to pay out its web for transport toward and with the conveyor 24. The splicing apparatus 44 may be of the type which can unite the trailing end of an expiring web with the leader of a fresh web without necessitating even short-lasting stoppage or pronounced deceleration of the machine. Splicing apparatus which can be utilized in the cigarette rod making machine of FIG. 1** are disclosed, for example, in commonly owned U.S. Pat. No. 3,925,131 granted Dec. 9, 1975 to Lothar Krause, in commonly owned U.S. Pat. No. 4,010,911 granted Mar. 8, 1977 to Bob Heitmann, and in commonly owned U.S. Pat. No. 4,131,501 granted, Dec. 26, 1978 to Hubert Böttcher et al.

Once the splicing operation is completed, the support 43 is pivoted through approximately 180° so that the spindle 25*a* takes the place of the spindle 22*a* and the expired reel 22 is then replaced (normally by hand) with a fresh reel whose leader is introduced into the splicing apparatus 44 so that it is ready to be spliced to the web which is being paid out by the reel 25.

Figure 2:
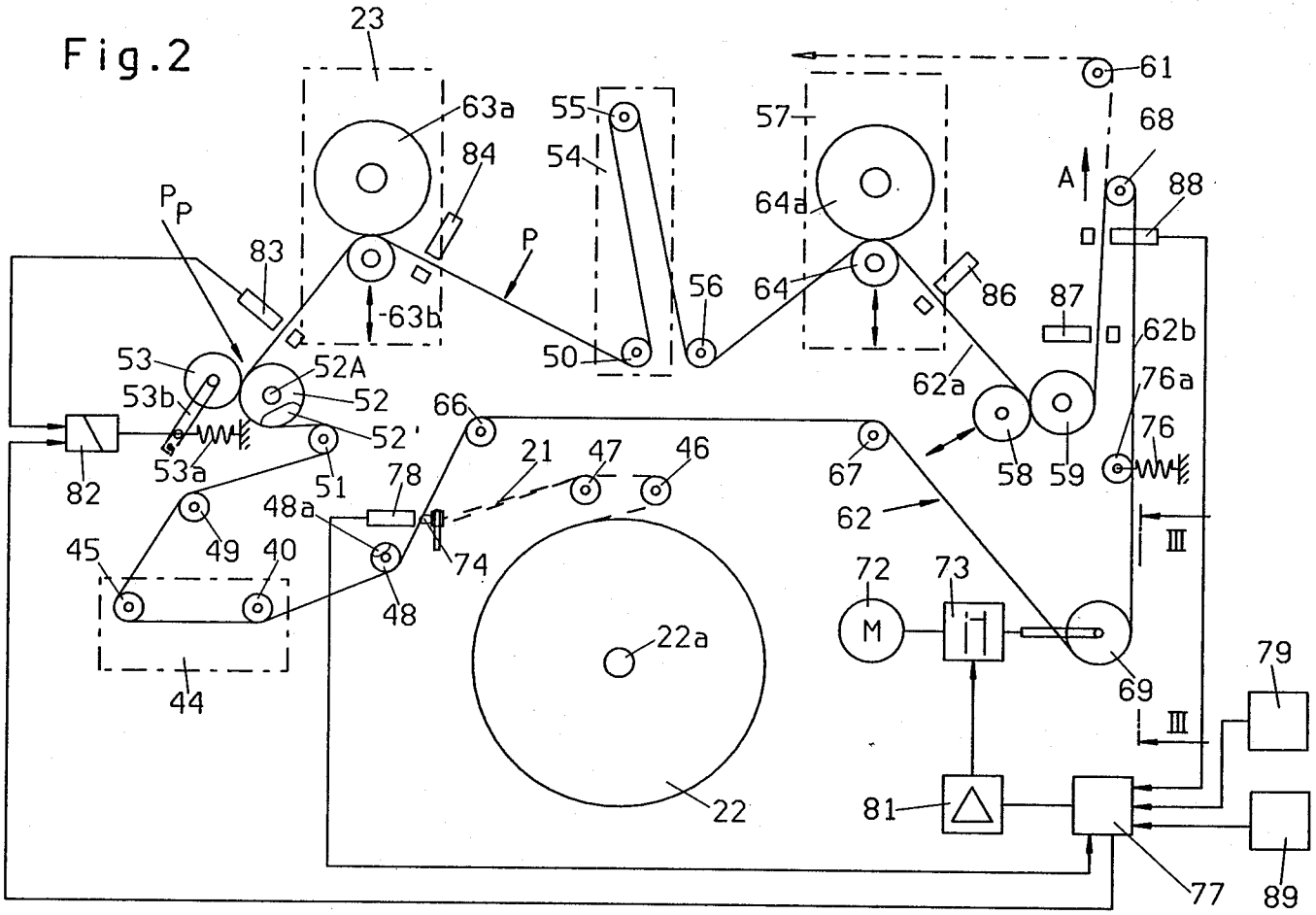
FIG. 2 is a schematic elevational view of a portion of the machine, showing the threading apparatus as well as the guide means which defines the path for a web of cigarette paper.

The path P along which the cigarette paper web 21 advances from the reel 22 toward the conveyor 24 of FIG. 1 is shown in FIG. 2. This path is a rather complex path because the web 21 must advance through a first imprinting mechanism 23 (which is also shown in FIG. 1), thereupon through a bronzing device 54 (e.g., a device of the type disclosed in commonly owned U.S. Pat. No. 3,820,505 granted June 28, 1974 to Manfred Goldbach et al.), and thereupon through a second imprinting mechanism 57 which may but need not be identical with or similar to the mechanism 23. On its way from the reel 22 toward the conveyor 24, each increment of the cigarette paper web 21 advances through a guide means which is defined by a plurality of rotary elements including guide rollers 46, 47, 48 which are mounted in or on the frame F upstream of the splicing apparatus 44, rollers 40, 45 which are installed in the splicing apparatus 44, additional guide rollers 49, 51, the expandible nip or obstruction $P_p$ between two advancing rollers 52, 53, the expandible nip or constriction between two guide rollers 63, 63*a* in the first imprinting mechanism 23, guide rollers 50 and 55 of the bronzing device 54, a further guide roller 56, the expandible nip or obstruction between the guide rollers 64, 64*a* in the second imprinting mechanism 57, the expandible nip or obstruction between two advancing rollers 58, 59, and a further guide roller 61 which deflects the web 21 into a substantially horizontal portion of the path P toward the upper reach of the conveyor 24.

The advancing roller 52 is driven by the main prime mover 72 of the cigarette rod making machine, and the advancing roller 53 is mounted on a pivotable lever 53*b* which is biased by a coil spring 53*a* so that the roller 53 tends to narrow the obstruction $P_p$ to a width which is barely sufficient for the passage of the web 21. The advancing roller 58 can cooperate with the driven advancing roller 59 in the same way as described in connection with the rollers 52 and 53.

The roller 63 is movable toward and away from the roller 63*a* in directions which are indicated by the double-headed arrow 63*b* and is biased toward the roller 63*a* by a suitable spring, not shown. The rollers 64 and 64*a* preferably cooperate in the same way as the rollers 63 and 63*a*.

The purpose of the advancing rollers 52, 53 is to draw the web 21 off the reel 22, and the purpose of the advancing rollers 58, 59 is to draw the web 21 through the imprinting mechanisms 23, 57 and bronzing device 54. When the web 21 breaks, or when a fresh web is to be threaded into and through the cigarette rod making machine between the support 43 and the conveyor 24, the leader of such web must be caused to advance along the path P from the roller 46 and toward and beyond the roller 61. In the absence of any means for facilitating or effecting such threading operation, the operation of the cigarette rod making machine must be interrupted for an extended period of time with attendant very high losses in output. This will be readily appreciated by bearing in mind that the aforementioned PROTOS machine can turn out well in excess of 7000 and also well in excess of 8000 cigarettes per minute.

In accordance with the invention, the cigarette rod making machine embodies or is combined with a web threading apparatus which comprises an endless flexible conveyor 62 having a first portion 62*a* which is adjacent to the path P and a second portion 62*b* whose path deviates from the path P. The portion 62*a* of the conveyor 62 is trained over a plurality of rotary elements in the form of sprocket wheels (the conveyor 62 is an endless chain conveyor) each of which is coaxial with a discrete rotary element of the guide means defining the path P for the web 21. FIG. 2 shows a portion of a sprocket wheel 52' on the shaft 52A of the guide roller 52. Similar sprocket wheels are mounted coaxially with the guide rollers 48, 40, 45, 49, 51, 63, 50, 55, 56, 64 and 59. The portion 62*b* of the conveyor 62 is trained over the sprocket wheels 68, 69, 67 and 66 which ensure that successive increments of the conveyor portion 62*b* reach the path P in the region where the web 21 enters such path between the guide rollers 47 and 48.

The sprocket wheel 69 constitutes a means for driving the chain conveyor 62 in the direction which is indicated by the arrow A, i.e., in such a way that the conveyor portion 62*a* advances in the direction of advancement of successive increments of the web 21 from the reel 22 toward the conveyor 24 of FIG. 1.

Figure 4:
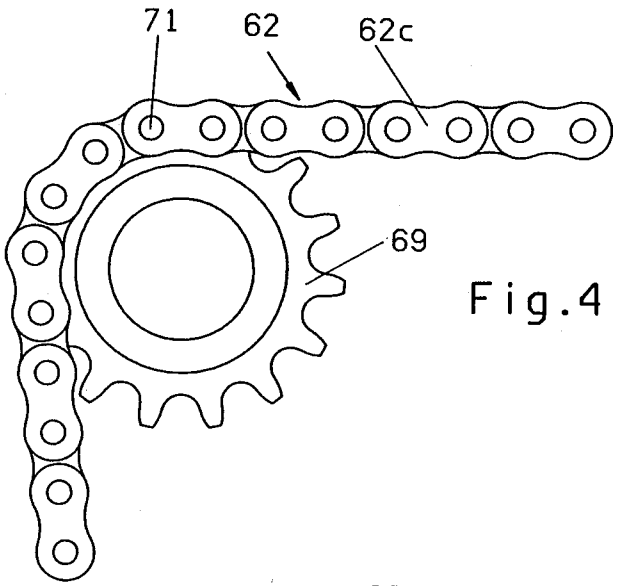
FIG. 4 is an end elevational view as seen in the direction of arrow IV in FIG. 3.
Figure 3:
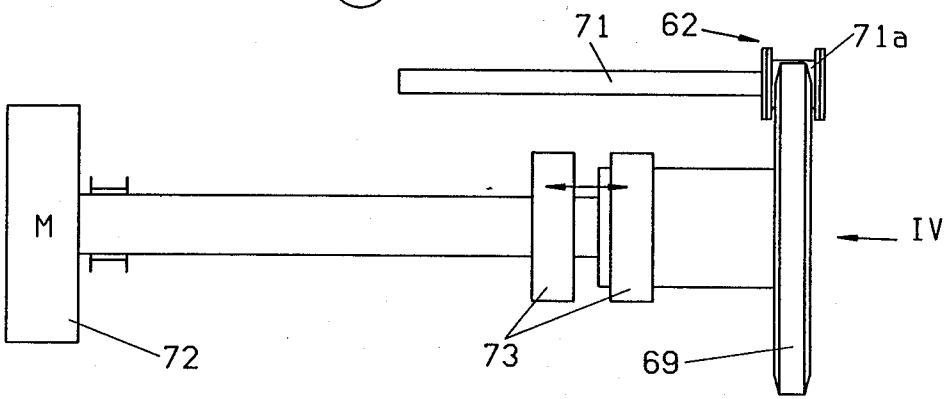
FIG. 3 is an enlarged view as seen in the direction of arrows from the line III—III of FIG. 2.

The means for transmitting motion from the main prime mover 72 (e.g., a variable-speed electric motor) of the cigarette rod making machine to the driving means 69 for the conveyor 62 comprises a clutch 73 which can be engaged or disengaged in response to signals from a control circuit 77 to an amplifier 81. The latter directly controls the clutch 73 in a manner which is well known from the art (the clutch 73 may constitute an electromagnetic clutch) and need not be described here. It suffices to say that the chain conveyor 62 is in motion only as long as the clutch 73 is engaged, namely, for a composite interval of time which suffices to advance a pin-shaped entraining member 71 on the conveyor 62 from a position between the sprocket wheel 66 and the sprocket wheel 48' (the latter is coaxial with the guide roller 48) and back to such position. The leader of the web 21 has a looped portion 74 which can receive the pin-shaped entraining member 71 so that the web 21 is pulled along the path P in a direction from the roller 47 toward the roller 61 when the looped portion 74 receives the member 71 and the conveyor 62 is in motion. The length of the pin-shaped entraining member 71 is preferably such that it extends transversely across the entire leader of the web 21. As can be seen in FIGS. 3 and 4, the member 71 can constitute an integral or detachable extension of a pin 71*a* which serves to connect the neighboring links 62*c* of the chain 62 to one another. However, it is equally possible to weld or otherwise (permanently or removably) secure the entraining member 71 directly to one of the links 62*c*.

Figure 5:
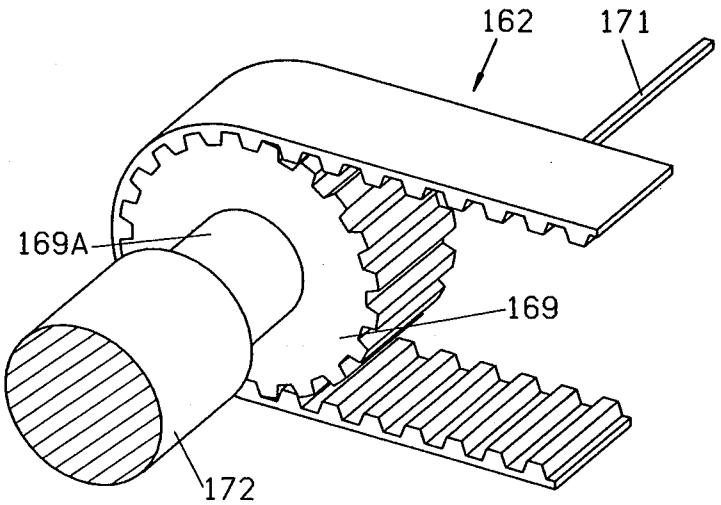
FIG. 5 is a fragmentary perspective view of a modified web threading apparatus.

FIG. 5 shows a portion of a modified threading apparatus wherein the chain conveyor 62 is replaced with a toothed belt conveyor 162. Therefore, the driving means 69 in the form of a sprocket wheel (FIGS. 3 and 4) is replaced by or designed to constitute a toothed pulley 169. The same holds true for the rotary elements (corresponding to the sprocket wheels 48' and 52' shown in FIG. 2) over which the toothed belt 162 is trained to have its first portion advance along the path P. The pin-shaped entraining member 71 is replaced by a clamping device 171 in the form of a tongs whose jaws can clamp the leader of a web therebetween so that the leader need not necessarily be provided with a looped portion 74. The shaft 169A of the toothed pulley 169 of FIG. 5 is driven by a discrete prime mover 172 which replaces the clutch 73 and is controlled by the amplifier 81 in response to signals from the control circuit 77. It is clear that the discrete prime mover 172 (e.g., a constant-speed or a variable-speed electric motor) can be used in the apparatus of FIG. 2 in lieu of the clutch 73 to drive the sprocket wheel 69 for the chain conveyor 62.

Referring again to FIG. 2, the control circuit 77 is designed to transmit signals to an electromagnet 82 or another suitable motor which can pull the lever 53*b* in a direction to the left, as viewed in FIG. 2 (i.e., against the opposition of the biasing means 53*a*), to increase the width of the path portion or obstruction $P_p$ which is defined by the components 52, 53 of the guide means that defines the path P. The extent of movement of the roller 53 away from the roller 52 in response to energization of the electromagnet 82 should suffice to allow for unimpeded passage of the looped portion 74 of the leader of the web 21 and of the entraining member 71 through the thus widened obstruction $P_p$. The roller 63 is mounted in the same or analogous way as the roller 53, i.e., it can be moved away from and back toward the associated roller 63*a* to thereby increase or reduce the width of the respective path portion or obstruction. The same holds true for the rollers 64 and 58. A tensioning roller 76*a*, which is biased by a spring 76, is provided to maintain the conveyor portion 62*b* under requisite tension and to thus compensate for shortening of the path P (i.e., of the conveyor portion 62*a*) when the roller 63 or 64 is moved away from the associated roller 63*a* or 64*a*. In the embodiment which is shown in FIG. 2, the length of the path P is not affected by movements of the rollers 53 and 58 toward or away from the associated rollers 52, 59. Signals for movements of the rollers 53, 63, 64, 58 away from the associated rollers 52, 63*a*, 64*a*, 59 are transmitted, in requisite sequence, by the outputs of the control circuit 77 which receives signals from a start button 79, from a restart button 89, and from several signal generating monitoring devices in the form of photocells which are adjacent to the path P and serve to transmit signals (either immediately or with requisite delay) in response to detection of the entraining member 71 in the respective portions of the path P. FIG. 2 shows photocells 83, 84, 86 and 87 which are respectively installed downstream of the rollers 53, 63, 64 and 59, and a further photocell 88 which is installed downstream of the sprocket wheel 68, as considered in the direction of advancement of successive increments of the conveyor portion 62*b*. The exact construction of the control circuit 77 forms no part of the invention.

The operation of the threading apparatus which includes the conveyor 62 and the pin-shaped entraining member 71 is as follows:

The entraining member 71 is held in the starting position of FIG. 2 which is determined by a photocell 78 serving to disengage the clutch 73 via control circuit 77 and amplifier 81 as soon as the entraining member 71 reaches the upstream end of the path P and causes the transducer of the photocell 78 to transmit a stop signal to the corresponding input of the control circuit 77. The looped portion 74 of the leader of the web 21 surrounds the entraining member 71; such engagement between the entraining member 71 and the looped portion 74 is effected by hand, i.e., the person in charge pulls the leader of the web 21 so that the reel 22 on the support 43 pays out a certain length of cigarette paper which suffices to train the leader over the guide rollers 46, 47 and to slip the looped portion 74 over the entraining member 71.

In order to start the threading operation, the attendant actuates the start button 79 whereby the control circuit 77 transmits a signal which causes the amplifier 81 to engage the clutch 73, i.e., the driving means 69 receives torque from the main prime mover 72 and sets the conveyor 62 in motion in the direction of arrow A. The entraining member 71 advances toward and beyond the sprocket wheel 48' and entrains the looped portion 74 of the leader of the web 21 in the same direction, i.e., the reel 22 is rotated in a (clockwise) direction to pay out the web. Actuation of the start button 79 further entails a movement of rollers 53, 63, 64, 58 away from the associated rollers 52, 63*a*, 64*a*, 59 so that the width of the corresponding obstructions increases. The resulting slack is taken up by the spring-biased sprocket wheel 76*a*. As mentioned above, the means for moving the rollers 53, 63, 64, 58 away from the associated rollers 52, 63*a*, 64*a*, 59 can comprise electromagnets (such as the electromagnet 82 for the advancing roller 53); however, other types of moving means can be employed with equal or similar advantage. For example, the electromagnets can be replaced by pneumatic motors which receive pressurized gaseous fluid from a suitable source by way of solenoid valves which can be energized and deenergized by the control circuit 77. The arrangement is preferably such that the rollers 53, 63, 64 and 58 reassume the positions which are shown in FIG. 2 (to thereby reduce the width of the corresponding obstructions) immediately or shortly after advancement of the entraining member 71 through the respective obstructions. Thus, when the entraining member 71 reaches the photocell 83 downstream of the first obstruction $P_p$, the control circuit 77 receives a signal which effects deenergization of the electromagnet 82 so that the spring 53*a* is free to contract and to return the advancing roller 53 to the illustrated position. The photocells 84, 86, 87 effect analogous return movements of the rollers 63, 64 and 58 so that the freshly threaded portion of the web 21 is ready to be advanced by the pairs of rollers 52-53 and 58-59 as soon as the threading operation is completed. If the rollers 52 and 59 are driven in the course of a threading operation (this is the preferred mode of operating the cigarette rod making machine), the pairs of rollers 52, 53 and 58, 59 assist the threading of the web along the path P by the conveyor 62 and entraining member 71.

The threading operation is interrupted and practically completed when the entraining member 71 is detected by the photocell 88. The signal which the photocell 88 transmits to the control circuit 77 entails a disengagement of the clutch 73 so that the conveyor 62 comes to a halt. An attendant then disconnects the looped portion 74 of the web 21 from the entraining member 71 and trains the leader of the web over the guide roller 61 prior to placing the leader onto the upper reach of the conveyor 24.

The operator thereupon depresses the restart button 89 which causes the control circuit 77 and amplifier 81 to reengage the clutch 73 so that the entraining member 71 begins to advance with the conveyor portion 62*b* back into the range of the photocell 78. The latter detects the oncoming entraining member 71 and transmits a signal which causes the control circuit 77 to arrest the driving means 69 by disengaging the clutch 73 via amplifier 81 so that the entraining member 71 is arrested in an optimum position for attachment of the looped portion 74 of a fresh web thereto.

If the path along which the web must be threaded is relatively short, e.g., if the cigarette rod making machine employs a single imprinting mechanism, the threading of the web can be carried out by the entraining member 71 alone, i.e., without assistance from one or more pairs of advancing rollers such as the rollers 52, 53 and 58, 59. This simplifies the circuitry of the threading apparatus because the monitoring means (such as 83, 84, 86, 87) for the entraining member 71 during travel along the pat for the web can be omitted, i.e., the mobile component of each pair of components of the guide means that defines the path for the web can be moved back to its operative position subsequent to arrival of the entraining member into the range of the photocell 88.

The operation of the apparatus which includes the structure of FIG. 5 is analogous to that of the apparatus of FIGS. 2–4. The control circuit then transmits signals to the prime mover 172. If desired, the operation of the clamping device 171 can be automated, at least to the extent that it releases the leader of a web when the latter is properly threaded through one or more imprinting mechanisms, a bronzing device and one or more pairs of advancing rollers.

The improved threading apparatus saves much time because manual threading of a web through the nips of the rollers 52, 53 and 58, 59 as well as through the imprinting mechanisms 23, 57 and bronzing device 54, can be completed within a minute fraction of the time which is required for completion of such operation by hand. Moreover, the threading is more predictable because the apparatus is not likely to skip any of the obstructions. This holds true for initial threading of the first of a long series of webs as well as for threading of the leader of a web in the event of breakage. Once the leader of the web has been advanced beyond the nip of the rollers 58, 59 which are shown in FIG. 2, the remainder of the threading operation (namely, the placing of the web onto the conveyor 24 so that it can be overlapped by the advancing rod-like tobacco filler) can be readily performed by hand with little loss in time.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for threading an elongated flexible web through a processing machine, particularly for threading a web of cigarette paper through a cigarette rod making machine, wherein the properly threaded web advances in a predetermined direction along a predetermined path and wherein a portion of said path includes of constitutes an expandible obstruction whose width normally suffices solely for advancement of the web therethrough, comprising an endless flexible conveyor having a portion extending along said path; means for driving said conveyor in said direction; entraining means provided on said conveyor and arranged to engage the leader of a web which is to be threaded through the machine; and means for expanding the obstruction of the path, at least while said entraining means advances the leader along said portion of said path, so that the expanded obstruction does not interfere with advancement of the entraining means along said portion of said path.

2. The apparatus of claim 1 for threading a web in a machine wherein the path is defined by a plurality of first rotary elements, further comprising a plurality of second rotary elements each coaxial with a discrete one of the first rotary elements, said conveyor being trained over said second rotary elements.

3. The apparatus of claim 1 for threading a web in a machine which comprises a prime mover, further comprising means for transmitting motion from the prime mover to said driving means.

4. The apparatus of claim 1, wherein said motion transmitting means comprises a clutch and further comprising means for engaging and disengaging said clutch.

5. The apparatus of claim 1, further comprising a discrete prime mover for said driving means.

6. The apparatus of claim 1 for threading a web having a leader which is provided with a loop, wherein said entraining means comprises a pin arranged to extend into the loop of the web which is about to be threaded through the machine.

7. The apparatus of claim 1, wherein said entraining means comprises a web clamping device.

8. The apparatus of claim 1, wherein said conveyor includes a chain conveyor.

9. The apparatus of claim 1, wherein said conveyor includes a toothed belt.

10. In a machine for processing elongated flexible webs, particularly in a cigarette rod making machine wherein a web of cigarette paper is draped around a tobacco filler, the combination of guide means defining an elongated path for advancement of a web in a predetermined direction and including at least one pair of components one of which is movable toward and away from the other of said pair of components to thereby increase the width of a portion of said path which portion normally constitutes an obstruction barely sufficient to allow for advancement of the web therethrough; and an apparatus for threading webs through said guide means, including an endless flexible conveyor having a portion extending along said path, means for driving said conveyor in said direction, entraining means provided on said conveyor and arranged to engage the leader of a web which is about to be introduced into said path, and means for moving said one component away from said other component to thereby increase the width of said portion of said path so that said entraining means can advance the leader of a web between said components.

11. The combination of claim 10, wherein said guide means includes a plurality of first rotary elements and further comprising a plurality of second rotary elements each coaxial with a discrete one of said first rotary elements, said conveyor being trained over said second rotary elements.

12. The combination of claim 10, further comprising a prime mover and means for transmitting motion from said prime mover to said driving means.

13. The combination of claim 12, wherein said motion transmitting means comprises a clutch and further comprising means for engaging and disengaging said clutch.

14. The combination of claim 10, further comprising a discrete prime mover for said driving means.

15. The combination of claim 10, wherein said apparatus is arranged to thread webs of the type having a leader provided with a loop, wherein said entraining means comprises a pin receivable in the loop of the web which is about to be threaded through said guide means.

16. The combination of claim 10, wherein said entraining means comprises a web clamping device.

17. The combination of claim 10, wherein said conveyor includes a chain conveyor.

18. The combination of claim 10, wherein said conveyor includes a toothed belt.

19. The combination of claim 10, wherein said components include rotary elements and further comprising means for biasing said one component in a direction to reduce the width of said obstruction.

20. The combination of claim 10, wherein said moving means includes a control circuit and further comprising signal generating monitoring means adjacent to at least one selected portion of said path and arranged to transmit to said control circuit signals in response to detection of said entraining means in said selected portion of said path.

* * * * *